United States Patent [19]

Fenton et al.

[11] Patent Number: 4,979,488

[45] Date of Patent: Dec. 25, 1990

[54] CAM OR ECCENTRIC WHEEL SHIELD

[76] Inventors: Bruce R. Fenton, 54 Hitching Post Dr.; Brian M. Robertson, 28 Mustang La., both of Cody, Wyo. 82414

[21] Appl. No.: 382,307

[22] Filed: Jul. 19, 1989

[51] Int. Cl.[5] ..... F41B 5/00

[52] U.S. Cl. ..... 124/25.6; 124/86; 124/88

[58] Field of Search ..... 124/23 R, 24 R, 25, 124/86, 88

[56] References Cited

U.S. PATENT DOCUMENTS

| | | | |
|---|---|---|---|
| 2,968,300 | 1/1961 | Allen | 124/23 R |
| 4,207,858 | 6/1980 | Blackstone | 124/23 R |
| 4,331,311 | 5/1982 | Russell | 124/23 R X |
| 4,365,611 | 12/1982 | Nishioka | 124/24 R |
| 4,457,287 | 7/1984 | Babington | 124/23 R |
| 4,714,070 | 12/1987 | Shelton | 124/86 |
| 4,796,598 | 1/1989 | Jones | 124/25 |

*Primary Examiner*—Randolph A. Reese
*Assistant Examiner*—John Ricci
*Attorney, Agent, or Firm*—Workman Nydegger Jensen

[57] ABSTRACT

A shield or protecting device which is attached to the split limb end section of a compound bow, a crossbow or any other archery device using a cam or eccentric wheel inserted into the split limb end section of the device. The shield is made in such a manner as to protect the cam or eccentric wheel when in a resting position, during the draw or in full extension of a compound bow, crossbow or any other archery device using a cam or eccentric wheel inserted into the split limb end section of the device. Space is provided in the cavity of the shield to protect the cam or eccentric wheel as it extends out over the split limb section of the compound bow, crossbow or other archery devices as described above. The shield is used to protect the cam or eccentric wheel and cable from any damage due to moisture, dirt, snow, twigs, rocks and any other foreign material which may cause damage to the cam or eccentric wheel and the cable when place on the ground. The shield is a quieting device, made in such a manner as to quiet the cam or eccentric wheel after the release of the arrow. The shield is also used to 'shield' visual movement of the cams or eccentric wheels from the view of the game as the compound bow, crossbow or other archery devece described above is being drawn.

13 Claims, 2 Drawing Sheets

CAM OR ECCENTRIC WHEEL SHIELD

BRIEF SUMMARY OF THE INVENTION

A shield or protecting device which is attached to the split-limb end section of a compound bow, a crossbow or any other archery device using a cam or eccentric wheel inserted into a split limb end section of the device. The shield is made in such a manner as to protect the cam or eccentric wheel when in a resting position, during the draw or in full extension or a compound bow, crossbow or any other archery device using a cam or eccentric wheel inserted into the split limb end section of the device. Space is provided in the cavity of the shield to protect the cam or eccentric wheel as it extends out over the split limb section of the compound bow, crossbow or other archery devices as described above. The shield is used to protect the cam or eccentric wheel and cable from any damage due to moisture, dirt, snow, twigs, rocks and any other foreign material which may cause damage to the cam or eccentric wheel and the cable when placed on the ground. The shield is a quieting device, made in such a manner as to quiet the cam or a-centric wheel after the release of the arrow. The shield is also used to 'shield' visual movement of the cams or eccentric wheels from the view of the game as the compound bow or crossbow or archery device described above is being drawn.

BACKGROUND OF THE INVENTION

This invention relates directly to an archer's compound bow, crossbow or any other archery device using a cam or eccentric wheel inserted into the split limb end section of the device. More precisely, the invention is an attachment for either or both split limb end sections of a compound bow, crossbow or archery device previously described.

A compound bow is a hunting and precision shooting instrument designed in such a way that both ends of the limb are split into a V-shape to allow the installation of one or more cams or eccentric wheels. The cams or eccentric wheels are attached by a pin through the cam or eccentric wheel to both the right and left section of the V-shape allowing the cam or wheel to pivot around the pin. The cable is strung in such a way to enable the archer to be at a full draw length with much less force than needed to drive the arrow to its destination. The design of the compound bow and displacement of the cam or eccentric wheel allow the bow to thrust the arrow forward at a much greater speed than attainable by a straight or recurve bow. The invention of the compound bow also added many new concerns for the archer. Now the archer must be concerned about the added sound of the release of the cable and the rotation of the cam or eccentric wheel from full extension into a resting position. It is common practice of the archer to rest one end of the bow on the ground while waiting for game or positioning the arrow. While not in use the compound bow if often left resting against a tree leaving one end of the bow in mud, dirt, grass, snow or whatever. With the invention of the compound bow the archer has need for a shield that will protect the cam or eccentric wheel from the mentioned elements which cause chipping of the cam or wheel and clogging of the cable. The invention of the compound bow also made the archer more visible to the prey by adding moving parts to each end of the bow.

The crossbow is a special type of archery weapon invented in medieval times. It consists of a short, powerful bow fastened horizontally across the end of a stock shaped much like those used on rifles. The arrow lies in a grove in the stock. The cable is drawn back behind a catch and is released by squeezing a trigger. Crossbows have also been improved by the placement of eccentric wheels or cams placed into the V-shape split limb section of the crossbow. The crossbow is then strung with cable in such a way that it enables the archer to draw the bow with much less force than needed to drive the arrow to its destination. The addition of the cams and eccentric wheels added the same concerns for the archer using a crossbow as that for the archer using a compound bow.

OBJECT OF THE INVENTION

As determined previously there is a need for a safeguarding shield which will protect the split limb end portion of a compound bow, crossbow or any other archery device using a cam or eccentric wheel inserted into the split limb end section of the device, the eccentric wheels or cams and the cable which is strung around the eccentric wheels or cams.

One object of the invention is to quiet the sound made when the arrow is released and the cams or eccentric wheels return to a resting position.

Yet another object of the invention is to shield the visual movement of the cams or a-centric wheels while the compound bow, crossbow or any other archery device previously decribed, is being drawn.

Yet another object is to provide a sheild protecting the split limb end portions, the cams or eccentric wheels and the cable on either end of a compound bow, crossbow or any other archery device previously described from dirt, snow, rocks, twigs or any other foreign objects which cause the cams or a-centric wheels to become clogged, chipped or damaged.

Other objects will become apparent to those skilled in the art of bow hunting as they become acquainted with the invention.

DETAILED DESCRIPTION OF THE PREFERRED EMBODIMENT

Figure 1:
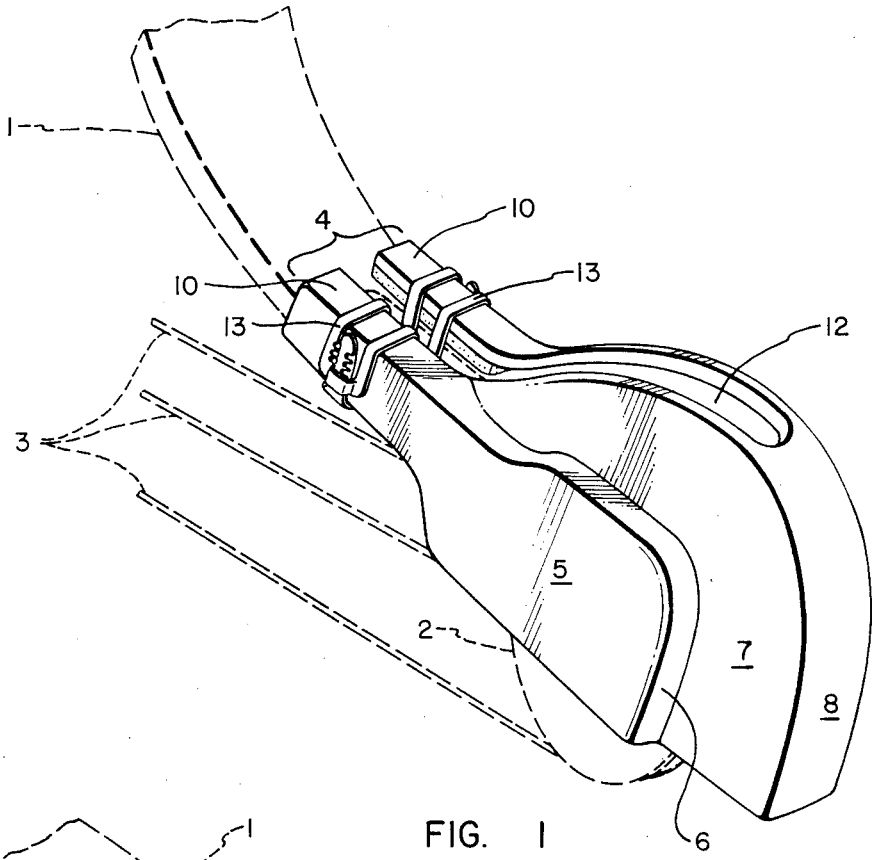
FIG. 1 is a back side view of the shield attached to one split limb end section of a compound bow while the bow is fully extended ready to be fired.
Figure 2:
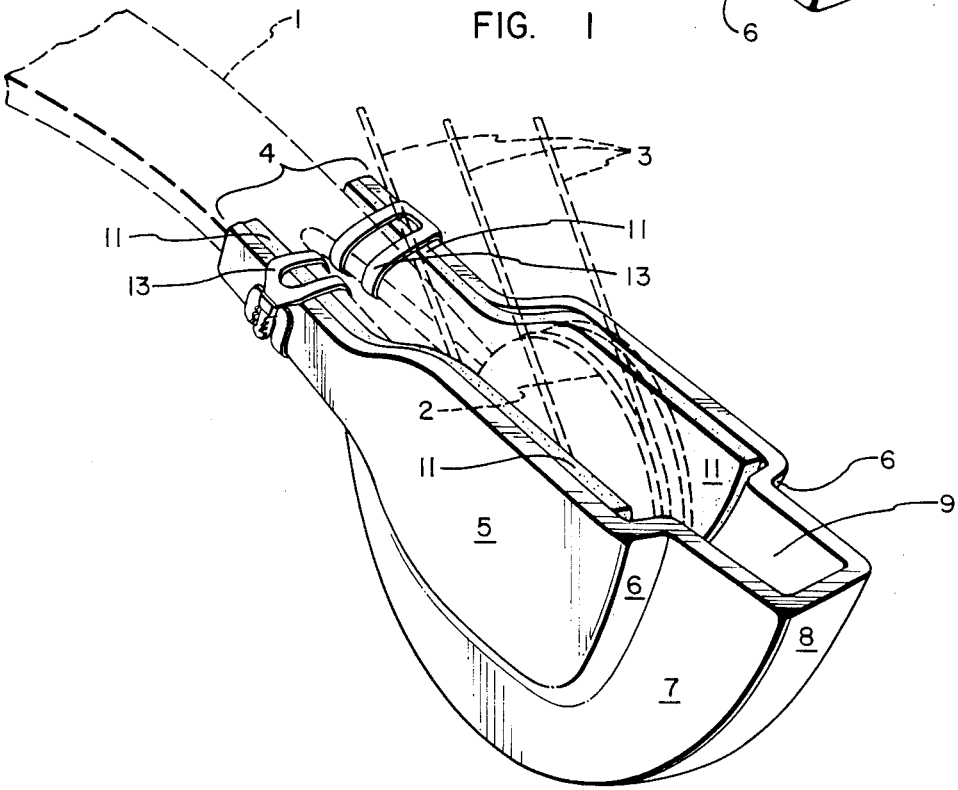
FIG. 2 is a front side view of the shield attached to one split limb end section of a compound bow showing the shield cavity and the cam or eccentric wheel in a resting position.

In all figures the shield housing is attached to the split limb end section of a compound bow 1 or crossbow protecting the cam or eccentric wheel 2, and the cable 3. The shield is of one complete unit which has an open end bottom 4 where the bow limb 1 slides into the shield. The shield consists of lower right and left lateral sides 5 which are just wide enough at the bottom 4, or proximal end, to receive the split limb end section of a compound bow 1 or crossbow. These lateal sides 5 continue parallel up each split limb end section 1 to a point where the shield angles toward the center creating a limb rest 6 then angles upward again forming the upper back 7, or distal end, arching at a certain point referred to as the top wall member 8 to create a semi-circular arched cavity 9 on the inside of the shield allowing a cam or eccentric wheel 2 to rotate within the cavity 9.

The top 8 and upper back 7 are a continuation of the right and left lateral sides 5 forming the semi-circular arched cavity 9. The lower back 10 is at a right angle to the lower right and left lateral sides 5 and is flat to fit securely against the front limb of a compound bow 1 or crossbow. The front of the shield is left completely open allowing placement of the shield on the split limb end section of a compound bow 1 or crossbow. The limb cavity 5 is provided with a lining 11 of foam or any sound absorbing material to quiet the release of the cam or eccentric wheel, to provide a tight fit on the split limb end section of a compound bow 1 or crossbow and to absorb the vibration created when the cable 3 is released. This lining 11 begins at the bottom 4 of the shield and covers the entire limb cavity 5 on the inside of the shield. It stops at the point where the shield narrows toward the semi-circular archer cavity 9 to form the limb rest 6.

Figure 3:
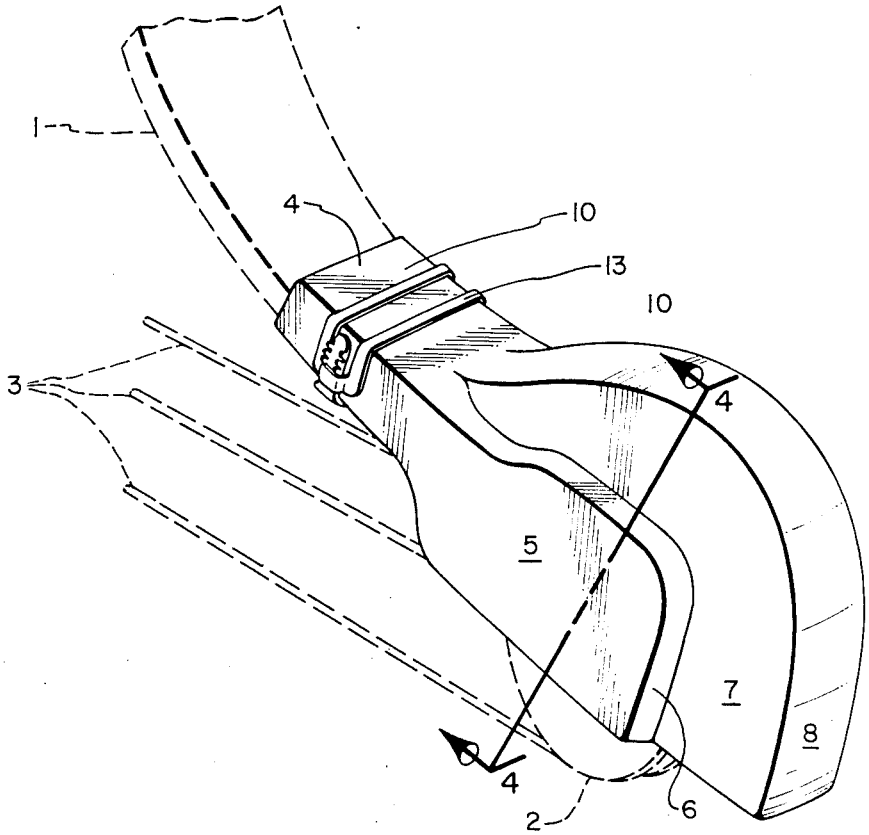
FIG. 3 is a back side view showing a solid shield using one fastener.
Figure 4:
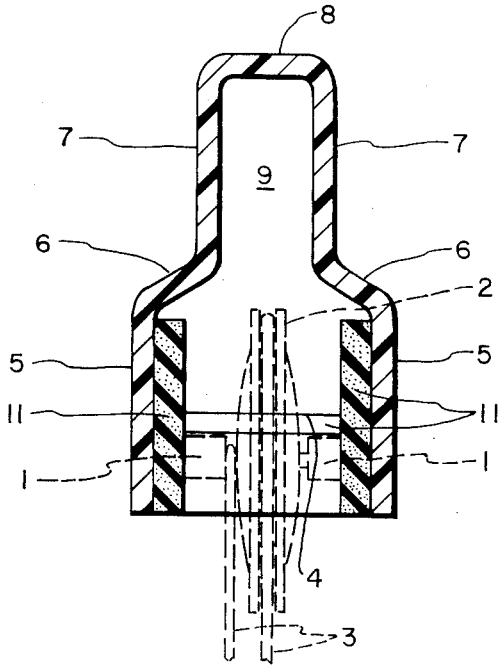
FIG. 4 is a bottom view showing the cam or eccentric wheel in a resting position.

It is an option of the shield to have a section 12 removed from the back, or from upper back 7, of the shield beginning at the bottom 4 of the lower back 10 and continuing up the lower back 10 into the back of the semi-circular arched cavity 9. This section may be of varied sizes and shapes including an oblong rectangular cut, a triangular cut, an S-shaped cut or any other variation. FIG. 3 shows the shield without a section removed, although #12 indicates where a section could be removed if desired.

The shield is attached to the compound bow 1 or crossbow or any other archery device previously described by one or more clamps or fasteners 13. In the event a section 12 has been removed from the shield, one or more clamps or fasteners 13 will encricle the lower right lateral side 5, the lower right back 10 and the right split limb end section of a compound bow 1, crossbow or any other archery device previously described. The fasteners or clamp 13 is securely clasp at any given flat side. One or more clamps or fasteners 13 are also attached to the left section encircling the lower left lateral side 5, the lower left back 10 and the left split limb section of a compound bow 1, crossbow or any other archery device previously described. The fastener or clamp 13 is securely clasp at any given flat side. A shield with section 12 removed will contain at one or more clamps or fasteners attaching the shield securely to the split limb end section of a compound bow 1, cross bow or any other archery device previously described.

In the event the shield does not have a section 12 removed (as in FIG. 3) the shield is attached by one or more clamps or fasteners 13 encircling the lower right lateral side 5, the lower back 10, the lower left lateral side 5 and both the right and left split limb end sections of a compound bow 1, crossbow or any other archery device previously described. The fastener or clamp 13 is securely clasp at any given flat surface.

The shield as thus described will vary in size as far as length from top 8 to bottom 4, width from right lateral side 5 to left lateral side 5 and depth from front to back to accommodate all sizes of cams and eccentric wheels 2.

The shield prevents clogging, chipping and damage to the cam or eccentric wheel 2 the cable 3 and the split limb end section of a compound bow 1, crossbow or any other archery device previously described. Since this end portion of the bow is where most damage and wear occurs, this shield will lengthen the life of a compound bow 1, crossbow or any other archery device previously described. This invention can be made with different kinds and weights of plastics by vacuum molding or mold injection. It can also be made of wood, metal, rubber, aluminum, fiberglass or other material the archer may request.

The lining 11 of foam or any other sound absorbing material in the limb cavity 5 quiets the sound made when a compound bow 1, crossbow or any other archery device previously described is fired and the cams or a-centric wheels return to a resting position. This 'quieting' is noticeable to the human ear. This 'quieting' is of utmost importance to the archer.

Thus the cam or eccentric wheel shield protects the cams or a-centric wheels 2, the cable 3 and the split limb end section of a compound bow 1, crossbow or any other archery device previously described from dirt, snow, rocks, twigs or any other foreign material causing clogging, chipping or wear to these various parts.

The cam oe eccentric wheel shield absorbs vibration and sound made when the compound bow or crossbow is fired and the cams or eccentric wheels return to a resting position thus quieting the compound bow, crossbow or any other archery device previously described.

The cam and eccentric wheel shield 'shields° the visual movement of the cams or eccentric wheels from the vision of the game being hunted.

Having thus described the invention, it should be understood that further modifications, separate from those described herein, may be made within the spirit and scope of this invention.

We claim:

1. A shield to be attached to a split limb section of a compound bow, crossbow, or any other archery device using a cam or eccentric wheel inserted into the split limb section, the shield comprising:

a housing defining a cavity comprising:

a pair of substantially parallel and coextensive side members each having a proximal end, a distal end, a front edge, and a back edge, the proximal ends sized and shaped to receive the split limbs of the bow essentially along the longitudinal axis of the bow limb, and distal ends extending beyond the maximum extension of the eccentric wheel assembly of the bow, and a wall member joining the side members along the back edges of the side members so as to define the cavity between the proximal and distal ends of the sidemembers, the configuration of the cavity such that it spans the eccentric wheel while permitting the operation of the bow cable(s); and means for rigidly attaching the housing to the bow.

2. A shield to be attached to a split limb section of a compound bow as defined in claim 1 wherein the side members have limb rests intregral to the side members within the cavity upon which the split limbs of the bow rest.

3. A shield to be attached to a split limb section of a compound bow as defined in claim 2 wherein the integral limb rest is formed by varying the planar configuration of the side member to create a seating surface against which a limb may rest.

4. A shield to be attached to a split limb section of a compound bow as defined in claim 1 wherein the side members in plan view are substantially semi-circular in shape.

5. A shield to be attached to a split limb section of a compound bow as defined in claim 1 wherein at least a portion of the cavity is lined with a shock and/or sound absorbing material.

6. A shield to be attached to a split limb section of a compound bow as defined in claim 1 wherein the wall member extends along the back edges of the sidemembers from the distal end of the side member toward the proximal end of the sidemembers terminating a distance from the proximal end of the sidemembers.

7. A shield to be attached to a split limb section of a compound bow as defined in claim 6 wherein the side members and wall member span only a distal portion of the eccentric wheel assembly.

8. A shield to be attached to a split limb section of a compound bow, crossbow, or any other archery device using a cam or eccentric wheel inserted into the split limb section, the shield comprising:

two, substantially coextensive side members having a substantially semicircular shape, and having a proximal and a distal end, a wall member joining the side members along the arcuate sides of the semicircular side members between the proximal and distal ends to define a housing with a cavity therein, the proximal ends of the side members configured to receive the split limbs of the bow essentially along the longitudinal axis of the bow limb, and means for attaching the proximal ends of the side members to the bow limb.

9. A shield to be attached to a split limb section of a compound bow as defined in claim 8 wherein the side members have limb rests intregral to the side members within the cavity upon which the split limbs of the bow rest.

10. A shield to be attached to a split limb section of a compound bow as defined in claim 9 wherein the integral limb rest is formed by varying the planar configuration of the side member to create a seating surface against which a limb may rest.

11. A shield to be attached to a split limb section of a compound bow as defined in claim 8 wherein at least a portion of the cavity is lined with a shock and/or sound absorbing material.

12. A shield to be attached to a split limb section of a compound bow as defined in claim 8 wherein the wall member extends along the arcuate sides of the sidemembers from the distal end toward the proximal end of the sidemembers terminating a distance from the proximal end of the sidemembers.

13. A shield to be attached to a split limb section of a compound bow as defined in claim 12 wherein the side members and wall member span only a distal portion of the eccentric wheel assembly.

* * * * *